US007587772B2

(12) United States Patent
Ward

(10) Patent No.: US 7,587,772 B2
(45) Date of Patent: Sep. 15, 2009

(54) INFANT NESTING DEVICE

(76) Inventor: DeBorah Ward, 4007 S. Drexel Blvd., Chicago, IL (US) 60653

( * ) Notice: Subject to any disclaimer, the term of this patent is extended or adjusted under 35 U.S.C. 154(b) by 190 days.

(21) Appl. No.: 11/245,496

(22) Filed: Oct. 7, 2005

(65) Prior Publication Data

US 2007/0079444 A1 Apr. 12, 2007

(51) Int. Cl.
*A47D 7/00* (2006.01)
*A47D 13/00* (2006.01)
*A47C 27/08* (2006.01)

(52) U.S. Cl. ..... 5/655; 5/654; 5/655.5; 5/904; 5/909

(58) Field of Classification Search ..... 5/655, 5/904, 636, 639, 694, 654, 655.5, 644, 909, 5/676

See application file for complete search history.

(56) References Cited

U.S. PATENT DOCUMENTS 2,512,641 A * 6/1950 Halstead ..... 455/157.1
3,946,316 A * 3/1976 Hough ..... 455/344
4,066,072 A * 1/1978 Cummins ..... 601/15
4,121,310 A * 10/1978 Gorran ..... 5/678
4,788,730 A * 12/1988 Bexton ..... 5/676
5,063,912 A * 11/1991 Hughes ..... 601/47
5,357,642 A * 10/1994 Clute ..... 5/655
5,865,771 A * 2/1999 Shuto et al. ..... 601/47
6,454,352 B1 * 9/2002 Konovalov et al. ..... 297/219.12
6,493,888 B1 * 12/2002 Salvatini et al. ..... 5/423
6,524,331 B1 * 2/2003 Kohout et al. ..... 607/96
6,692,330 B1 * 2/2004 Kulick ..... 446/297
6,708,352 B2 * 3/2004 Salvatini et al. ..... 5/423
6,904,157 B2 * 6/2005 Shima ..... 381/388
7,162,048 B2 * 1/2007 Shima ..... 381/334
7,198,605 B2 * 4/2007 Donofrio et al. ..... 600/559
7,261,106 B2 * 8/2007 Donofrio ..... 128/204.21
2003/0084511 A1 * 5/2003 Salvatini et al. ..... 5/423
2004/0258270 A1 * 12/2004 Shima ..... 381/396
2005/0066970 A1 * 3/2005 Donofrio ..... 128/204.21
2005/0066971 A1 * 3/2005 Donofrio ..... 128/204.23
2005/0070812 A1 * 3/2005 Donofrio ..... 600/552
2005/0070813 A1 * 3/2005 Donofrio et al. ..... 600/559
2005/0070814 A1 * 3/2005 Donofrio et al. ..... 600/559
2005/0070815 A1 * 3/2005 Shahrestani et al. ..... 600/559
2005/0070822 A1 * 3/2005 Donofrio et al. ..... 600/595
2005/0070823 A1 * 3/2005 Donofrio et al. ..... 600/595
2005/0070824 A1 * 3/2005 Rhad et al. ..... 600/595
2006/0010604 A1 * 1/2006 Kamrin-Balfour ..... 5/655
2006/0010605 A1 * 1/2006 Kamrin-Balfour ..... 5/655
2007/0061975 A1 * 3/2007 Hernandez ..... 5/639
2007/0074348 A1 * 4/2007 Carlton ..... 5/639
2007/0079444 A1 * 4/2007 Ward ..... 5/655

* cited by examiner

*Primary Examiner*—Robert G Santos
(74) *Attorney, Agent, or Firm*—McDermott Will & Emery LLP

(57) ABSTRACT

An infant nesting device is provided. The infant nesting device comprises a bottom surface, a sidewall and at least one audio speaker. The bottom surface has a defined perimeter and is formed from a substantially cushioning material. The sidewall is attached to the bottom surface and surrounds at least a portion of the perimeter of the bottom surface. The sidewall is formed from a substantially cushioning sound permeable material. The speaker is disposed in the sidewall and is adapted for operable connection to an external audio device.

8 Claims, 2 Drawing Sheets

INFANT NESTING DEVICE

CROSS-REFERENCE TO RELATED APPLICATIONS

None.

TECHNICAL FIELD

The invention relates to an infant nesting device, and more particularly, to an infant nesting device for premature infants which simulates the in-utero experience.

BACKGROUND OF THE INVENTION

The gestational period is of prime importance in human development. Each trimester of gestation targets specific functions in the construction of a fetus' body and mind. When infants arrive in a pre-term status, the gestational period is truncated, and a myriad of challenges may arise. Although neonatology has made significant advances in caring for pre-term infants, there still exist some concerns.

Once the critical period of cardiopulmonary functioning is stabilized, the infant continues to require a "nesting" period to support growth and continued development as if in-utero. A stimulation of the intrauterine environment offers the pre-term infant an opportunity to grow as if gestation had not been interrupted. Thus, a need exists to provide a nesting environment that effectively simulates environmental features of an intrauterine experience.

The present invention is provided to solve the problems discussed above and other problems, and to provide advantages and aspects not previously provided. A full discussion of the features and advantages of the present invention is deferred to the following detailed description, which proceeds with reference to the accompanying drawings.

SUMMARY OF THE INVENTION

According to the present invention, an infant nesting device is provided. The infant nesting device comprises a bottom surface, a sidewall and at least one audio speaker. The bottom surface has a defined perimeter and is formed from a substantially cushioning material. The sidewall is attached to the bottom surface and surrounds at least a portion of the perimeter of the bottom surface. The sidewall is formed from a substantially cushioning sound-permeable material. The speaker is disposed in the sidewall and is adapted for operable connection to an external audio device.

According to another aspect of the present invention, the cushioning material forming the sidewall is a resilient foam material.

According to still another aspect of the present invention, the bottom surface of the nesting device is detachably coupled to the sidewall.

According to yet another aspect of the present invention, the nesting device further comprises a receiver disposed in the sidewall. The receiver is operably coupled to the audio speaker and may be adapted to receive wireless transmission of an audio signal from an external audio device.

According to one aspect of the present invention, an infant nesting device is provided. The infant nesting device comprises a bottom surface, a sidewall and an audio recorder. The bottom surface has a perimeter and comprising a flexible enclosure with a fluid encapsulated therein. The sidewall attached to at least a portion of the perimeter of the bottom surface and is formed from a substantially cushioning and sound-permeable material. The audio recorder is at least partially disposed in the sidewall and is adapted to broadcast recorded audio signal of a heartbeat and including at least one audio speaker.

According to this embodiment of the present invention, the audio device may be a transceiver adapted to at least receive and broadcast a wireless audio signal.

According to another aspect of the present invention, a method of pacifying an infant is provided. According to the method, a nesting device is provided. The nesting device comprises a bottom surface, a sidewall and at least one audio speaker. The bottom surface has a perimeter and comprises a flexible enclosure having a fluid encapsulated therein. The sidewall is attached to at least a portion of the perimeter of the bottom surface and is formed from a substantially cushioning and sound-permeable material. The audio speakers are disposed in the sidewall, and are operably coupled to an audio recorder and a microphone. The speakers, in conjunction with the audio recorder, are adapted to broadcast recorded audio signal of a heartbeat. According to the method, the heartbeat of a maternity patient is recorded onto the audio device. An infant is subsequently place in the nesting device, and the recorded heartbeat is broadcasted through the audio speakers and into the nesting device.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
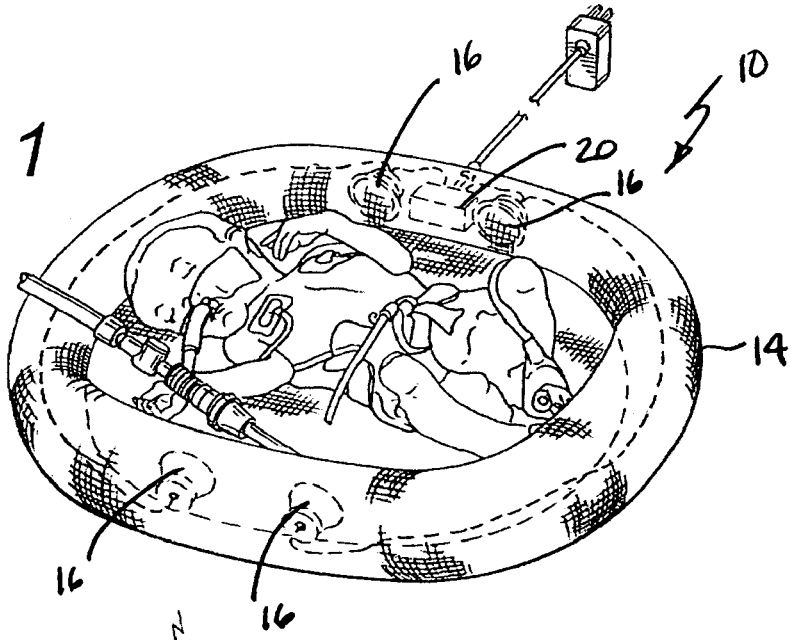
FIG. 1 is a perspective view of a nesting device according to the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention generally relates to a nesting device 10 for and infant. In particular, the present nesting device 10 is provided to simulate the in-utero experience of an infant by providing a simulated womb, embryonic fluid and audible maternal heartbeat as would be present in-utero. Referring now to FIGS. 1-6, the infant nesting device 10 of the present invention comprises a bottom surface 12, a sidewall 14 and at least one audio speaker 16.

It is of great importance to exercise substantial care with infants, and particularly with premature infants, as they continue to develop outside of the womb. Accordingly, the bottom surface 12 has a defined perimeter and is formed from a substantially cushioning material. In a preferred embodiment, the bottom surface 12 is a flexible enclosure having a fluid encapsulated therein. Preferably, the fluid encapsulated in the flexible closure is silicone. However, it is contemplated by the present invention that the fluid can be any suitable fluid for providing a soft and deformable bottom surface 12 upon which an infant may rest. Alternatively, the bottom surface 12 may be formed from a resilient foam. It is also preferable that the bottom surface 12 be covered with a plush, hypoallergenic material, such as sheepskin, fleece, velour, boa fabric, tricot fiber, polyester fiber, or any other suitable material for use with infants. This covering is particularly important when using the nesting device 10 with premature infants that tend to have fragile skin.

As shown in FIGS. 1-6, the sidewall 14 of the nesting device 10 is attached to the perimeter of the bottom surface 12. Preferably, the sidewall 14 surrounds the entire perimeter of the bottom surface 12. However, it may be desirable that the sidewall 14 is attached only to a portion of the perimeter of the bottom surface 12 so that one end of the nesting device 10 can be easily accessed for purposes of changing or otherwise accessing an infant cradled therein. According to one embodiment of the invention, the sidewall 14 is preferably formed from a substantially cushioning sound-permeable material. For example, the sidewall 14 can be formed from a resilient foam material such as polyester, a poly-fiber blend fiber, or from any other material suitable for protecting an infant placed within the nesting device 10 while also providing structural support to the nesting device 10. It is also preferable that the sidewall 14 be covered with a hypoallergenic plush material, such as sheepskin, fleece, velour, boa fabric, tricot fiber, polyester fiber, or any other suitable material for use with infants.

In use, the sidewall 14 or bottom surface 12 of the nesting device 10 may become dirty, worn or damaged. Accordingly, it may be desirable to detach the sidewall 14 from the bottom surface 12 of the nesting device 10 for separate cleaning or replacement. According to one embodiment of the present invention shown in FIG. 3, the bottom surface 12 of the nesting device 10 is detachably coupled to the sidewall 14. The bottom surface 12 may be detachably coupled to the sidewall 14 by any one of various means known to those of skill. For example, the sidewall 14 can be attached to the bottom surface 12 by snaps, buttons, zippers, Velcro™ or other suitable attachment devices that allow for detachable connection of the sidewall 14 from the bottom surface 12.

As shown in FIGS. 1-6, the nesting device is also includes at least one audio speaker 16 disposed in the sidewall 14. It is contemplated that the audio speaker 16 is a conventional audio speaker 16 that can be operably connected to an external audio device. To reduce the risk of injury to an infant resting in the nesting device 10, the audio speaker 16 is preferably entirely disposed within the cushioning material of the sidewall 14. However, it is also contemplated that a body of the speaker 16 be disposed within a cavity in the sidewall 14, and the output end of the speaker 16 be externally accessible through an inner portion of the sidewall 14. In such an embodiment, the speaker 16 will typically include a removable cover made from a soft material such as the resilient foam from which the sidewall 14 is preferably formed. The audio speaker 16 is operably coupled to an audio device comprised of an audio recorder 20 and a microphone. The external audio device may be an audio cassette recorder, a compact disc (CD) recorder an MP-3 recorder or any other audio device suitable for at least playback of a recorded audio track. It is further contemplated that the external audio device may be a the central processing unit ("CPU") of a computer, a personal digital assistant ("PDA") or other device suitable for playback of a recorded audio track. Specifically, it is desirable that the audio recorder 20 is adapted to broadcast an audio signal of a recorded heartbeat or soothing musical tones.

In one embodiment of the present invention shown in FIG. 1, the nesting device 10 includes an internal audio recorder 20 at least partially disposed in the sidewall 14. According to this embodiment, the entire audio recorder 20, including the audio speaker 16, is disposed as a self-contained unit within the sidewall 14. The audio recorder 20 may include an internal microphone, or the audio recorder 20 can have an input for receiving an external microphone. The audio recorder 20 may be an audio cassette recorder, a compact disc (CD) recorder an MP-3 recorder or any other audio device suitable for both recordation and playback of a recorded audio track.

Figure 2:
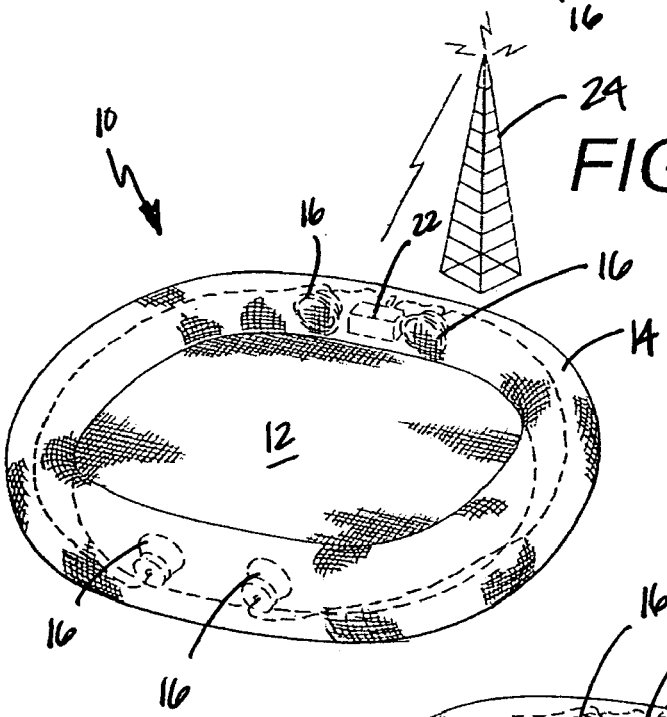
FIG. 2 is a perspective view of another embodiment of the nesting device according to the present invention.
Figure 3:
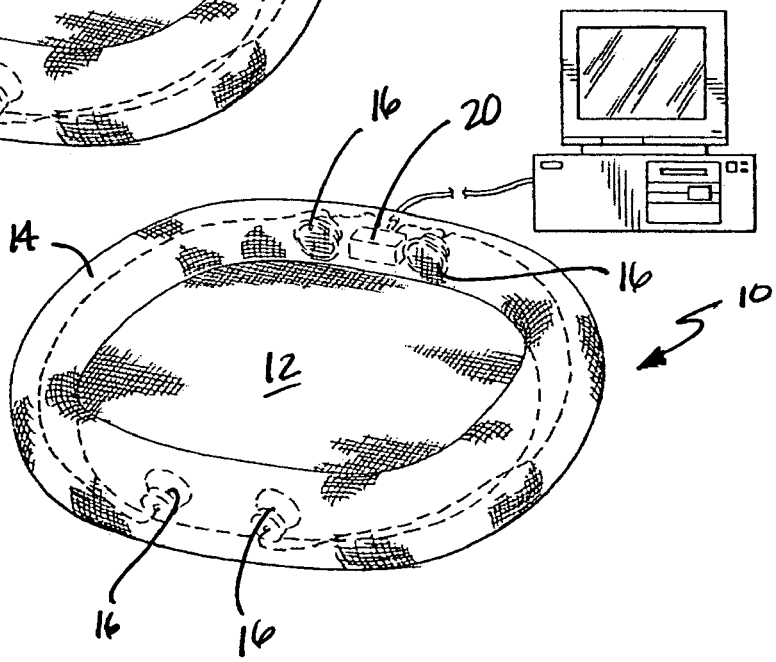
FIG. 3 is a perspective view of another embodiment of the nesting device according to the present invention.
Figure 5:
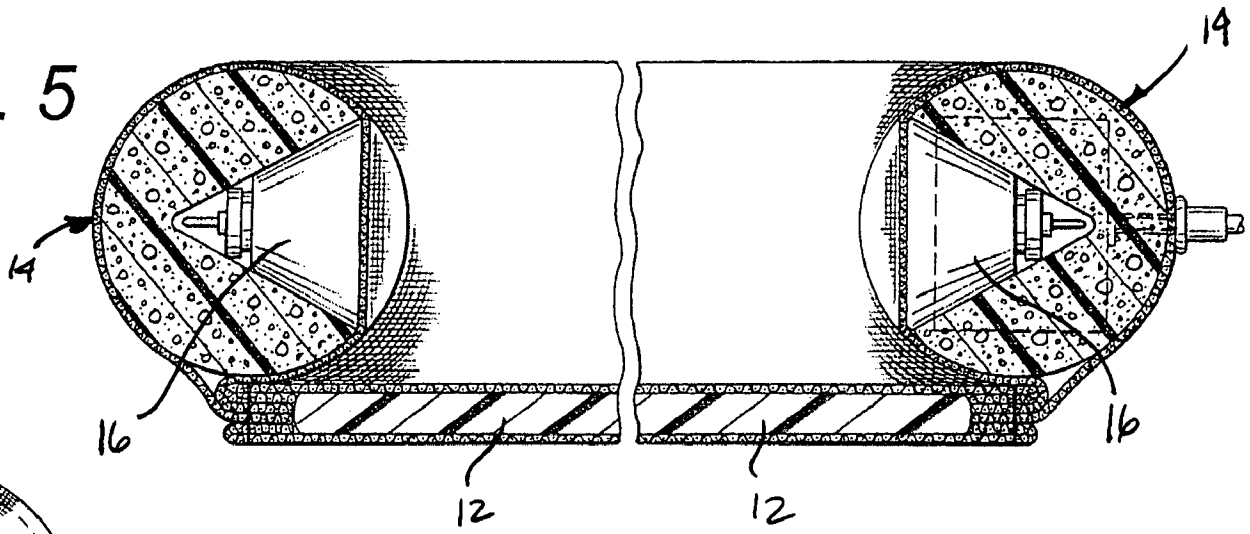
FIG. 5 is a cross-sectional view of the nesting device shown in FIG. 4 as taken through line 5-5.
Figure 6:
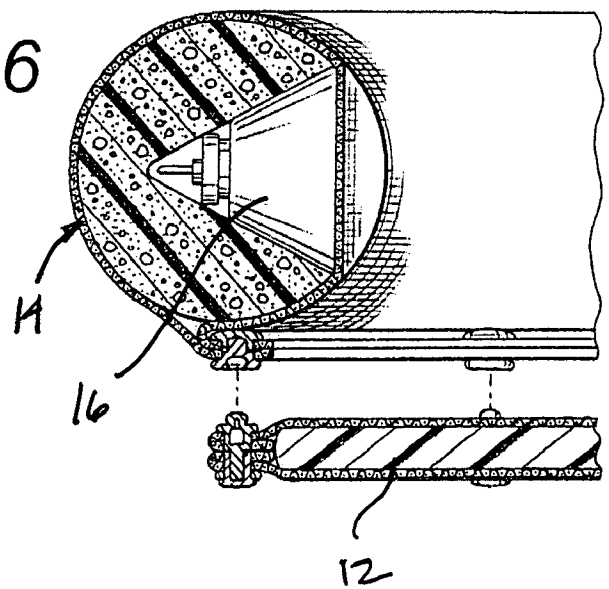
FIG. 6 is a partial cross-sectional view of the nesting device according to one embodiment of the present invention.
Figure 4:
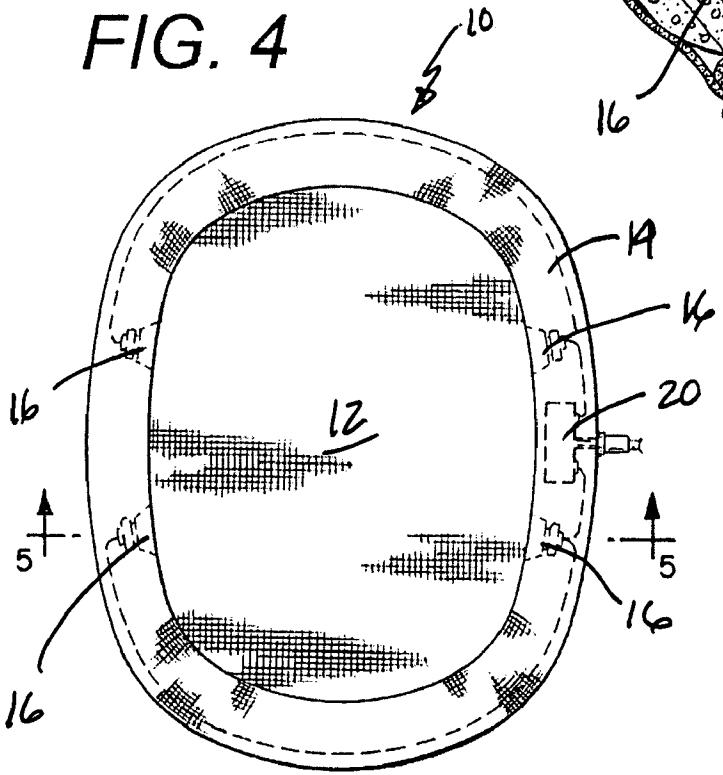
FIG. 4 is a top view of the nesting device shown in FIG. 3.

According to one embodiment of the present invention shown in FIG. 2, the nesting device 10 further includes a receiver 22 disposed in the sidewall 14 and operably coupled to the speaker 16. According to such an embodiment, the receiver 22 is adapted to receive wireless transmission of an audio signal. Thus, an audio signal in the form of a recorded heartbeat or musical tones may be transmitted from a remote transmitter 24 via radio frequency, satellite signal or other known audio transmission means to the receiver 22 within the nesting device 10 without the use of external wiring. It will be understood by those in the art that the audio signal may be transmitted by any known transmitter capable of wirelessly transmitting an audio wave or signal.

In use, it is important that the sound being projected into the nesting device 10 be maintained at a level that will not be detrimental to the infant resting therein. For example, excessive exposure to loud noise may result in tinnitus or temporary or permanent hearing loss. Accordingly, it is preferable that sound emanating from the speaker 16 into the nesting device 10 be between 10 decibels and 50 decibels.

As discussed herein, the present invention is meant to simulate the intrauterine environment of pre-term infants by allowing optimum growth as an infant is ensconced in the nesting device 10. The silicone bottom surface 12 of the cradle device, in combination with the cushioning sidewalls, simulate the infant's in-utero experience. Furthermore, the transmission of predetermined an audio signal in the form of a mother's heartbeat encourages the emotional and psychological bonding that had been interrupted due to an early-term delivery. Accordingly, the following description is directed to the method of using the nesting devices 10 to pacify an infant. According to the method of the present invention, a nesting device 10 of the type described herein is provided. The heartbeat of a maternity patient is recorded onto the audio device. Methods of recording heartbeat audio are known in the art. An infant is placed in the nesting device 10, and the recorded heartbeat is broadcasted through the audio speaker 16 and into the nesting device 10.

While the specific embodiments have been illustrated and described, numerous modifications come to mind without significantly departing from the spirit of the invention, and the scope of protection is only limited by the scope of the accompanying Claims.

What is claimed is:

1. An infant nesting device comprising:

a bottom surface defining an infant resting surface of the nesting device, the bottom surface having a perimeter and being formed from a substantially non-rigid cushioning material, and the bottom surface forming the bottom most portion of the infant nesting device;

a sidewall comprising a substantially non-rigid cushioning material, the sidewall traversing the entire perimeter of the bottom surface and having a top sidewall surface and a bottom sidewall surface, the outer perimeter of the bottom surface being attached to the sidewall proximate the bottom sidewall surface; and at least one audio speaker disposed in the sidewall, the at least one audio speaker provided for operable connection to an external audio device in order to simulate environment features of an intrauterine experience.

2. The nesting device of claim 1 further comprising a receiver disposed in the sidewall and operably coupled to the audio speaker.

3. The nesting device of claim 2 wherein the receiver is adapted to receive wireless transmission of an audio signal from an external audio device.

4. The nesting device of claim 1 further comprising an external audio device operably coupled to the audio speaker, the external audio device comprising an audio recorder and a microphone operably coupled to the audio recorder.

5. The nesting device of claim 1 wherein the bottom surface comprises a flexible enclosure having a fluid encapsulated therein.

6. The nesting device of claim 5 wherein the fluid encapsulated in the flexible closure is silicone.

7. The nesting device of claim 1 wherein the bottom surface is detachably coupled to the sidewall.

8. A method of pacifying an infant, the method comprising the steps of:

providing a nesting device comprising:

a bottom surface defining an infant resting surface of the nesting device, the bottom surface having a perimeter and being formed from a substantially non-rigid cushioning material, and the bottom surface forming the bottom most portion of the infant nesting device;

a side wall comprising a substantially non-rigid cushioning material, the sidewall traversing the entire perimeter of the bottom surface and having a top sidewall surface and a bottom sidewall surface, the outer perimeter of the bottom surface being attached to the sidewall proximate the bottom sidewall surface; and, at least one audio speaker disposed in the sidewall, the at least one speaker being operably coupled to an audio recorder and a microphone;

recording a heartbeat of a maternity patient on the audio recorder;

placing an infant in the nesting device; and broadcasting the recorded heartbeat through the speaker in order to simulate environment features of an intrauterine experience.

* * * * *